US005342572A

United States Patent [19]

Stangle et al.

[11] Patent Number: 5,342,572

[45] Date of Patent: Aug. 30, 1994

[54] COMBUSTION SYNTHESIS PROCESS UTILIZING AN IGNITABLE PRIMER WHICH IS IGNITED AFTER APPLICATION OF PRESSURE

[75] Inventors: Gregory C. Stangle, Alfred; William C. Williams, Wellsville, both of N.Y.

[73] Assignee: Alfred University, Alfred, N.Y.

[21] Appl. No.: 127,331

[22] Filed: Sep. 27, 1993

Related U.S. Application Data

[63] Continuation-in-part of Ser. No. 54,753, Apr. 27, 1993.

[51] Int. Cl.[5] ..... B22F 1/00

[52] U.S. Cl. ..... 419/45; 419/38; 419/48; 419/63

[58] Field of Search ..... 419/10, 12, 17, 45, 419/63, 38, 39, 48

[56] References Cited

U.S. PATENT DOCUMENTS

| | | | |
|---|---|---|---|
| 3,353,954 | 11/1967 | Williams et al. | 75/201 |
| 4,155,755 | 5/1979 | Sara | 75/200 |
| 4,251,272 | 2/1981 | Sara | 75/200 |
| 4,431,448 | 2/1984 | Merzhanov | 75/238 |
| 4,446,242 | 5/1984 | Holt | 501/96 |
| 4,459,363 | 7/1984 | Holt | 501/96 |
| 4,466,829 | 8/1984 | Nishigaki et al. | 75/240 |
| 4,585,618 | 4/1986 | Frensel et al. | 419/12 |
| 4,650,519 | 3/1987 | Chang et al. | 75/246 |
| 4,655,830 | 4/1987 | Akashi et al. | 75/233 |
| 4,676,829 | 6/1987 | Chang et al. | 75/246 |
| 4,746,363 | 5/1988 | DeAngelis | 75/244 |
| 4,762,558 | 8/1988 | German et al. | 75/246 |
| 4,762,577 | 8/1988 | Nagarajan et al. | 75/244 |
| 4,946,643 | 8/1990 | Dunmead et al. | 419/12 |

*Primary Examiner*—Donald P. Walsh
*Assistant Examiner*—Anthony R. Chi
*Attorney, Agent, or Firm*—Howard J. Greenwald

[57] ABSTRACT

In accordance with this invention, there is provided a process for producing a shaped article in which a reaction mixture containing at least two elemental materials is first charged into a die to form a shaped green body. A uniaxial pressure of from about 500 to about 5,000 pounds per square inch of cross-sectional area of the green body is then uniaxially applied to the green body, and the green body is then ignited; during ignition, the uniaxial pressure of from about 500 to about 5,000 pounds per square inch is maintained at a substantially constant level and continually applied to the reaction mixture.

19 Claims, 5 Drawing Sheets

COMBUSTION SYNTHESIS PROCESS UTILIZING AN IGNITABLE PRIMER WHICH IS IGNITED AFTER APPLICATION OF PRESSURE

REFERENCE TO RELATED PATENT APPLICATION

This is a continuation in part of copending U.S. patent application Ser. No. 08/054,753, filed on Apr. 27, 1993 pending.

FIELD OF THE INVENTION

A process for preparing a reinforced intermetallic composition consisting of only a matrix phase and reinforcement phase.

BACKGROUND OF THE INVENTION

Combustion synthesis processes involve highly exothermic reactions. These processes are well known to those skilled in the art and are disclosed, e.g., in U.S. Pat. Nos. 4,948,761, 4,957,885, 4,990,295, 5,006,290, 5,011,800, 5,030,600, 5,071,797, 5,143,668, 5,145,619, and the like. The disclosure of each of these patents is hereby incorporated by reference into this specification.

It is also known that exothermic reactions are difficult to obtain and control. Thus, for example, U.S. Pat. No. 2,886,454 of Todd discloses that " . . . certain exceedingly troublesome problems and limitations are encountered in any attempt to produce metal carbides of acceptable properties by exothermic procedures (column 1, lines 68–71). At column 2 of his patent, Todd discloses that "For such an exothermic reaction to be successful, it must produce a sufficiently high temperature to result in the formation of a carbide mass . . . . It has been found that most mixtures of metal oxides, aluminum, and carbon . . . fail completely to produce a carbide mass . . . . One difficulty in attempting to theorize as to whether a particular mixture will be operative is that the product is a complex of compounds that do not reveal ordinary valence relationships . . . . "

Many different attempts have been made to simultaneously form and densify an object by a combustion synthesis process, and these attempts usually have met with, at most, limited success.

Thus, e.g., in an article by Yoshinari Miyamoto et al. entitled "Simultaneous Synthesis and Densification of Ceramic Components under Gas Pressure by SHS" (appearing in "Combustion and Plasma Synthesis of High-Temperature Materials," Edited by Z. A. Munir et al., VCH Publishers, Inc., New York, N.Y., 1990, at pages 163–169), a combustion synthesis process is described in which gas pressure is isostaticaly applied to the reaction mixture prior to the time the mixture is ignited. Because the process of this patent applies pressure to the reaction mixture from every direction, it is difficult to obtain a shaped object. Furthermore, because it often takes a substantial period of time to prepare the sample for reaction, to preheat the gas which provides the isostatic pressure, to increase the pressure from such gas, and to cool the gas after the reaction, this process is often cumbersome, time consuming, and expensive.

Thus, e.g., in an article by Jerry C. LaSalvia et al. entitled "Densification of Reaction-Synthesized Titanium Carbide by High-Velocity Forging" (Journal of the American Ceramic Society, Volume 75, No. 3, March, 1992, pages 592–602), some of the problems with prior art combustion synthesis processes were illustrated. In the process of this publication, after a green compact had been ignited and converted into its final product, the resulting microstructure was collapsed by high velocity forging. LaSalvia disclosed that, in this process, there is a "time window" in which successful densification could be accomplished which is " . . . between 5 and 10 s after ignition" (see page 594). However, as is disclosed on pages 595–596 of this article, many of the densified products formed by this process evidenced a substantial number of microcracks.

Thus, e.g., at pages 229–237 of the same "Combustion and Plasma Synthesis . . . " publication, an article by S. D. Dunmead et al. (entitled "Combustion Synthesis in the Ti—C—Ni—Al System) discussed the drawbacks of the combustion synthesis reactions. At page 229 of this publication, the authors stated that "One of the major drawbacks in the combustion synthesis (SHS) of refractory materials is the highly porous nature of the products. This porosity is caused by three basic factors: (1) the molar volume change inherent in the reaction, (2) the porosity present in the unreacted sample, and (3), adsorbed gases." Dunmead et al. then describe a process in which, after ignition of the reaction mixture occurred, hydraulic rams were compressed to exert force upon the reaction mixture. However, the physical properties of the products produced by this process were far from ideal.

Dunmead was also issued U.S. Pat. No. 4,946,643, in which he and his copatentees described a process similar to that disclosed in his specification. It appears that the process of the Dunmead patent requires the use of a substantial amount of energy and is not readily suitable for preparing large shaped objects.

In the process of the Dunmead et al. patent, a compact of starting materials is charged to a die (such as the cylindrical graphite die depicted in FIG. 2), and the entire compact is heated up to its ignition temperature. In the embodiment illustrated in the Examples of the patent, the die assembly was heated to a temperature of from 933 to 1173 degrees Kelvin to cause ignition of the reaction mixture disposed within it.

In the process of the Dunmead et al. patent, a current was used which was sufficient to cause " . . . the die to rapidly heat up (approximately 1500 degrees K./minute) . . . " (see column 13 of the patent). Although the Dunmead et al. patent does not specify either the size of the die used or the electrical properties of the die assembly, it does disclose that the voltage used was only " . . . approximately 5 volts . . . . " Thus, it appears that a very large current would have to be used to raise the die/compact assembly 1,500 degrees Kelvin in one minute.

The use of such a very large current in the Dunmead et al. process requires a substantial amount of energy to be transmitted to die in a relatively short period of time. In addition to being inefficient, there is some indication in the literature that the transmission of such a large amount of electrical energy in a relatively short period of time may create electromagnetic radiation which, some believe, is harmful to human beings.

In the Dunmead et al. process, as soon as ignition of the compact occurred (as sensed by a thermocouple), " . . . the hydraulic rams were compressed to 20.7 MPa . . . and the electrical potential was turned off . . . " (see Example 1). Within about two minutes after ignition (see Column 5), the hydraulic rams had compressed the ignited compact.

Intermetallic compounds, which are alloys of two metals, are well known to those skilled in the art. Although they possess good strength properties at elevated temperatures, they tend to "creep:" after a period of time at high temperature, the materials tend to lose structural integrity.

Attempts have been made to ameliorate the creep problem of these materials by incorporating reinforcing agents within the intemetallic matrices. However, at the elevated temperaures these compositions are often processed under, frequently for extended periods of time, reactions frquently occur between the matrix material and the reinforcing agent, thereby adversely affecting the properites of both.

Attempts thus have also been made to ameliorate the reactivity problem of the reinforcing agents by coating them with "nonreactive" compounds such as, e.g., silicon carbide. However, even these allegedly "nonreactive" coatings react with the matrix material at the temperatures and times used for processing the compositions, and/or at the temperatures and times under which these materials are used.

It is an object of this invention to provide a combustion synthesis process in which ignition is caused with only a minimal expenditure of energy.

It is another object of this invention to provide a combustion synthesis process which produces a densified product which is substantially stronger and less porous than comparable prior art processes.

It is yet another object of this invention to provide a combustion synthesis process which can readily, effectively, and economically produce relatively large shaped products with excellent properties.

It is yet another object of this invention to provide a ceramic composition with improved high-temperarure properties which consists of an intermetallic matrix phase and a reinforcing phase.

SUMMARY OF THE INVENTION

In accordance with this invention, there is provided a process for producing a shaped article in which a reaction mixture is first charged into a die to form a shaped green body. A uniaxial pressure of from about 500 to about 5,000 pounds per square inch of cross-sectional area of the green body is then uniaxially applied to the green body, and the green body is then ignited; during ignition, the uniaxial pressure of from about 500 to about 5,000 pounds per square inch is maintained at a substantially constant level and continually applied to the reaction mixture.

BRIEF DESCRIPTION OF THE DRAWINGS

The invention will be illustrated by reference to the following drawings, in which like numerals refer to like elements, and in which.

DESCRIPTION OF THE PREFERRED EMBODIMENTS

Figure 1:
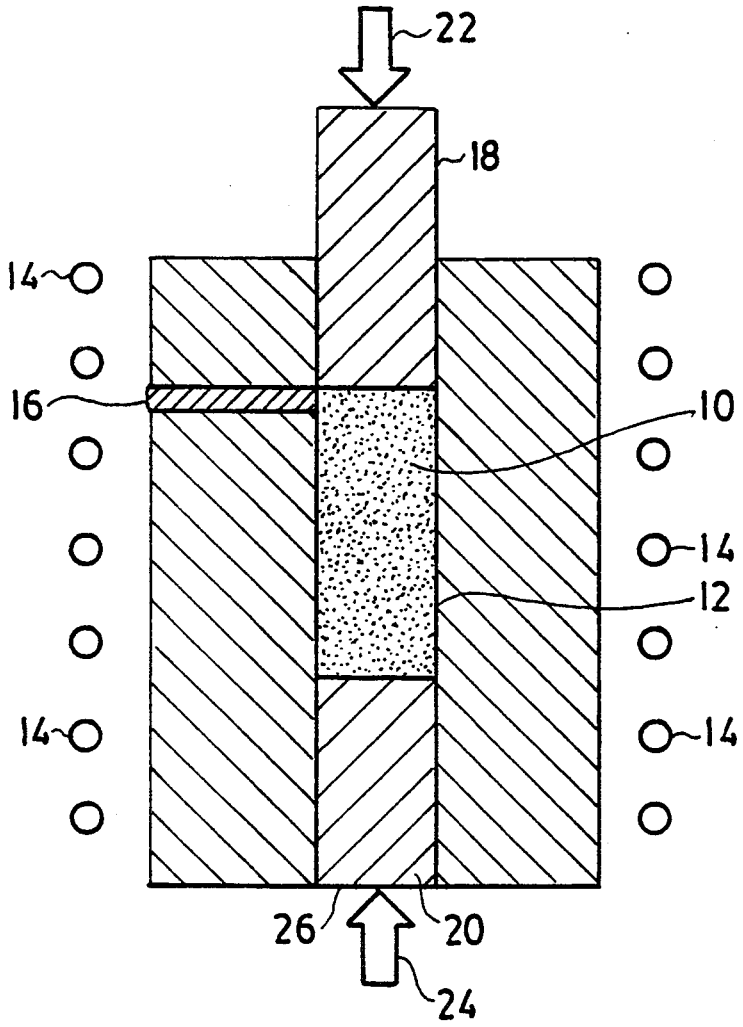
FIG. 1 is a sectional view of one portion of a reactor which may be used in one embodiment of applicants' process.

In the first portion of applicants' specification, a detailed description of preferred embodiments of their process will be presented. Thereafter, in the second portion of the specification, preparation of two-phase intermetallic/reinforcing agent compositions will be described.

The Preferred Process of the Invention

In the first step of applicants' process, a combustion synthesis reaction mixture 10 is charged to die 12. In general, the reaction mixture 10 is preferably comprised of at least two solid particles with different chemical and/or physical identities which are capable of exothermically reacting with each other after ignition of such mixture. Thus, by way of illustration and not limitation, one may use any of the reagent mixtures described in United States Government Report LMSC (Lockheed Missiles and Space Company, Inc. of Palo Alto, Calif.) D879371, published Dec. 1, 1984 by Alexander P. Hardt and entitled "Review of Self Propagating High Temperature Synthesis Technology."

In one preferred embodiment, the reaction mixture charged to die 10 is comprised of at least two elements, each of which is a solid material and, preferably, is finely divided. In this embodiment, it is preferred that each of such elements be in powder form and have a particle size distribution such that substantially all of its particles are smaller than about 500 microns and, more preferably, are from about 1 to about 100 microns. Particle size distribution analyses may be conducted by conventional means such as, e.g., those means disclosed in U.S. Pat. No. 4,812,427, the disclosure of which is hereby incorporated by reference into this specification.

In one preferred embodiment, the reaction mixture used in applicants' process is similar to that used in U.S. Pat. No. 4,946,643 of Dunmead et al., the entire disclosure of which is hereby incorporated by reference into this specification. Thus, e.g., the reaction mixture is comprised of at least one element from the following groups: (a) a group consisting of titanium, zirconium, hafnium, tantalum, niobium, silicon, and boron, (b) a group consisting of carbon and boron, (c) a group consisting of nickel, titanium, and copper, and (d) a group consisting of aluminum, iron, and cobalt.

In one preferred embodiment, at least one element from each of groups (a), (b), (c), and (d) is present in the reaction mixture. In this embodiment, if the element selected in group (a) is silicon or boron, than the element of group (b) is carbon. If the element selected from group (c) is titanium, then the element selected from group (d) is not titanium. If nickel is selected in group (c), then either aluminum or titanium are selected in group (d). If copper is selected in group (c), then aluminum is selected in group (d).

In another embodiment, the reaction mixture is comprised of at least one element from each of the following groups: (e) titanium, zironcium, hafnium, tantalum, and niobium, (b) carbon and boron, and (f) nickel, iron, cobalt, aluminum, and copper.

In one embodiment, the elements in the reaction mixture are nickel and aluminum. In one aspect of this embodiment, it is preferred that such mixture contain from about 72 to about 78 moles of nickel per 100 moles of the mixture of nickel and aluminum (72 to 78 mole percent). In another aspect of this embodiment, it is preferred that the reaction contain from about 42 to about 68 mole percent of nickel.

In another embodiment, the elements in the reaction mixture are iron and aluminum. In one aspect of this embodiment, it is preferred that the mixture contain from about 20 to about 30 moles of aluminum per 100 moles of the mixture of aluminum and iron. In another aspect of this embodiment, the reaction mixture contains from about 45 to about 55 mole percent of aluminum.

Aluminum and cobalt may be used in the mixture. In one aspect of this embodiment, one may use from 47 to 78 mole percent of cobalt.

Aluminum and titanium may be used in the mixture. In one aspect of this embodiment, one may use from about 48 to about 72 mole percent of aluminum. In another aspect of this embodiment, one may use from 73 to 77 mole percent of aluminum.

Nickel and titanium may be used in the reaction mixture. In one aspect of this embodiment, from about 48 to about 53 moles of nickel are present for every 100 moles of nickel and titanium. In another aspect of this embodiment, about 75 mole percent of nickel are used.

Molybdenum and silicon may be used in the reaction mixture. In fact, as will be apparent to those skilled in the art, many other combustion synthesis reaction mixtures may be used. These reaction mixtures are described in the United States patents listed elsewhere in this specification.

In one embodiment, in addition to the first two metallic elements, a third element may also be present in the reaction mixture. In general, the first and second metallic element comprise at least about 90 weight percent of the reaction mixture (by combined weight of all three elements), and each is generally present in a concentration exceeding 10 weight percent; the third element preferably comprises from about 0.1 to about 10.0 weight percent of the total mixture. Thus, by way of illustration and not limitation, one may use 50 moles of titanium, 48 moles of aluminum, and 2 moles of vanadium. One may use 68 moles of titanium, 27 moles of aluminum, and 5 moles of niobium. One may also use 67 moles of aluminum, 8 moles of nickel, and 25 moles of titanium. Other suitable reaction mixtures will be readily apparent to those skilled in the art.

Suitable third elements include, e.g., boron, carbon, vanadium, chromium, niobium, beryllium, iron, manganese, mixtures thereof, and the like.

In one embodiment, it is preferred that at least 90 weight percent of the reaction mixture (by total weight of all materials) be comprised of at least two of the aforementioned metallic compounds.

In one embodiment, the reaction mixture is comprised of an elemental reducing agent and a compound which acts as an oxidizing agent. Thus, by way of illustration and not limitation, one may use a reaction mixture containing 60 grams of aluminum, 130 grams of titanium oxide, and 20 grams of carbon (see Example 1 of U.S. Pat. No. 5,071,797), or 1200 grams of carbon black, 130 grams of titanium dioxide, and 60 grams of aluminum (see Example 2 of U.S. Pat. No. 5,071,797), or 28.4 grams of silica quartz sand, 17.7 grams of coated aluminum powder, 5.5 grams of carbon black, and 10 grams of calcined alumina (see Example 1 of U.S. Pat. No. 5,143,668), or 28.4 grams of silica quartz sand, 17.7 grams of coated aluminum powder, 5.5 grams of carbon black, and 10 grams of silicon carbide (see Example 2 of U.S. Pat. No. 5,143,668), or 16.81 grams of copper oxide, 4.04 grams of tin oxide, 6.34 grams of silica, and 8.84 grams of aluminum (see Example 1 of U.S. Pat. No. 5,145,619), or 27.45 grams of aluminum powder, 31.37 grams of molybdenum oxide, and 26.19 grams of silicon dioxide (see Example 1 of U.S. Pat. No. 5,011,800), and the like. Many other combinations of reagents will be readily apparent to those skilled in the art.

Referring again to FIG. 1, the reaction mixture 10 is preferably charged into die 12 in which it may be compressed, ignited, and reacted. It is preferred that die 12 consist essentially of graphite, for graphite has a very high melting point, has good structural integrity for this use, and has good thermal conductivity. Other substantially inert dies with high melting points and good physical properties at high temperatures also may be used.

Graphite die 12 may be constructed by conventional means. Thus, e.g., graphite die 12 may be machined from a graphite rod sold by Poco Graphite, Inc. of 1601 South State Street, Decatur, Tex.

Referring again to FIG. 1, the combustion synthesis reaction mixture 10 is charged to die 12. In one embodiment, after the reaction mixture 10 is charged to die 12, it is uniaxially pressed with a force of from about 500 to about 4,000 pounds per square inch prior to, during, as well as after the time it is ignited.

In one embodiment, it is preferred to ignite the reaction mixture 10 within a reactor (not shown) in which the mixture may be preheated prior to ignition. Although the reactor is not shown in FIG. 1, the heating elements 14 placed within the reactor are schematically illustrated.

In one preferred embodiment, after the reaction mixture 10 has been charged to die 12, but prior to the time it has been ignited, such mixture is preheated. In one aspect of this embodiment, the mixture is preheated to a temperature of from about 250 to about 600 degrees Centigrade.

The reaction mixture may be ignited by conventional combustion synthesis ignition means such as, e.g., igniter 16. In one embodiment, igniter 16 is a silicon carbide resistive heating element, such as, e.g., the one manufactured by the Norton Company of Milford, N.H. Alternatively, one may use any suitable source of heat such as a spark, a flame, a beam, a hot wire (such as a tungsten wire, a nichrome wire), and the like.

In one embodiment, not shown, the top of the reaction mixture contains a readily ignitable mixture. Thus, e.g., one may use from about 1 to about 20 grams disposed on the top of the reaction mixture of an ignitable mixture of metal powders. One can use, e.g., a mixture of titanium powder (with from 1 to 100 micron particle size) and boron powder (with from 0.1 to 20 micron particle size), using about 2 moles of boron per mole of titanium. Other ignitable powder mixtures are known to those skilled in the art.

Referring to FIG. 1, it is preferred to insert bottom ram 20 into die 12 prior to the time the reaction mixture 10 is charged into the die. After such charging, one may insert top ram 18 into the die until it is contiguous with the reaction mixture.

Once the reaction mixture 10 is disposed within die 12 and is contiguous with rams 18 and 20, a uniaxial force is preferably applied to such reaction mixture in the direction of arrows 22; inasmuch as ram 20 is fixed in place, an equal and opposite force is also applied to the reaction mixture 10 in the direction of arrow 24. In the embodiment illustrated in FIG. 1, the bottom 26 of ram 20 is disposed on a surface (not shown) which restrains its downward movement.

It will be understood by those skilled in the art that other means of applying uniaxial force to the reaction mixture 10 may also be used.

It is preferred that the force applied in the direction of arrow 22, and of arrow 24, be from about 500 to about 5,000 pounds per square inch of cross-sectional area of the green body of reagent in the die. This pressure is substantially lower than the pressure used in many prior art combustion synthesis forming and densification processes.

Many means of applying a uniaxial pressure of from about 500 to about 5,000 p.s.i. to the green body may be used. One such means is illustrated in FIG. 2.

Figure 2:
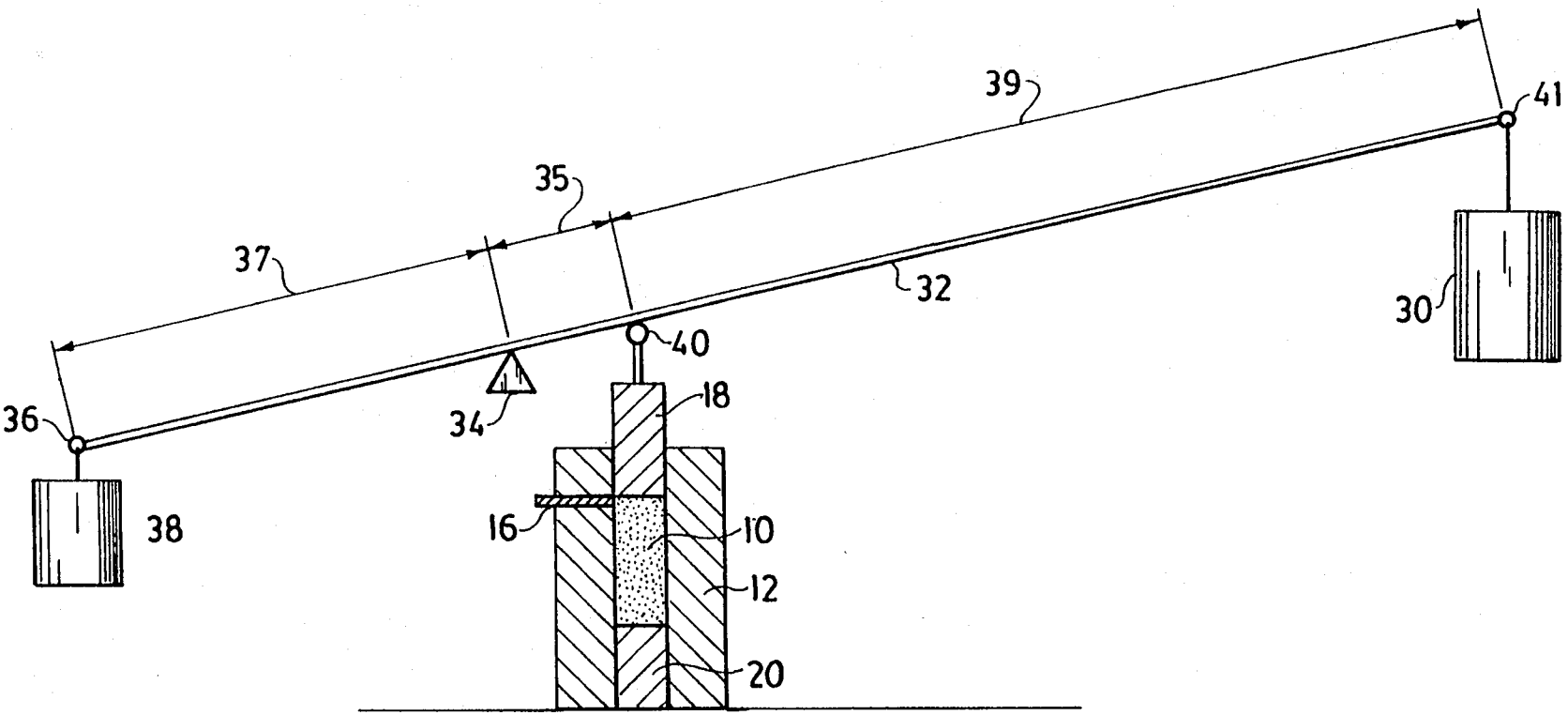
FIG. 2 is a sectional view of another portion of a reactor which may be used in one embodiment of applicants' invention.

Referring to FIG. 2, it will be seen that weight 30 is attached to lever arm 32 which, in turn, is pivotally attached to pivot point 34. Lever arm 32 extends past pivot point 34 to point 36, at which point it is attached to counterweight 38.

In one embodiment of the invention, weight 30 is from about 20 to about 80 pounds, weight 38 is from about 25 to about 35 pounds, the distance 35 from pivot point 34 to point 40 (where ram 18 is attached) is from about 6 to about 12 inches (and is preferably about 6 inches), the distance 37 from the point 36 (at which counterweight 38 is attached) to the pivot point is 24 inches. The distance 39 from the point 40 of the attachment of the ram 18 to the point 41 of the attachment of weight 30 is 54 inches.

As will be apparent to those skilled in the art, for any given system, and any given apparatus, the force applied to the top of the reaction mass will preferably be constant from a time prior to ignition to a time subsequent to ignition. To the extent, if any, that the reaction mass liquefies, the ram 18 may travel downwardly into the die cavity and force molten reaction mass into said cavity.

Control of the Adiabatic Temperature

In one embodiment, it is preferred that the reaction mixture 10 charged to die 12 have an adiabatic temperature which is lower than boiling point of the lowest boiling reactant in the mixture. As is known to those skilled in the art, the term "adiabatic" refers to an occurrence which takes place without the loss or gain of heat.

For any given reaction system, the boiling point of each component of the reaction mixture may be determined by reference to standard handbooks. Thus, e.g., the boiling point of aluminum is 2,060 degrees Centigrade, and the adiabatic temperature of a reaction mixture containing aluminum should not exceed 2,060 degrees Centigrade.

Means for determining the adiabatic temperature of a reaction mixture are well known to those skilled in the art. See, e.g., an article by A. G. Merzhanov, "Self-Propagating High-Temperature Synthesis: Twenty Years of Search and Findings," published at pages 1 to 53 of "Combustion and Plasma Synthesis of High-Temperature Materials," edited by Z. A. Munir et al. (VCH Publishers, Inc., New York, N.Y., 1990). Reference also may be had to an article by Scott E. Niedzialek et al. entitled "Combustion Synthesized Functionally Gradient Refractory Materials" which was submitted for publication to the Journal of Materials Research on Dec. 14, 1992.

In general, it is preferred that the adiabatic temperature of the reaction mixture be from about the melting point of the lowest-boiling reactant in reaction mixture 10 to about 10 degrees less than such boiling point. It is more preferred to have the adiabatic temperature of the reaction mixture be at least about 50 degrees less than said boiling point.

As is known to those skilled in the art, the adiabatic temperature of a mixture may be modified by including therein "inclusions" whose reaction differs from the reaction temperature of the other reagents. It is preferred, however, to not include so much diluent that the adiabatic temperature is more than about 400 degrees less than the boiling point of the lowest boiling reagent. In one especially preferred embodiment, the adiabatic temperature is no less than about 300 degrees less than the boiling point of the lowest boiling reagent.

The "inclusions" moderate the temperature generated during the combustion synthesis reactions. The use of these type of moderators, or of other combustion synthesis moderators, is discussed in U.S. Pat. No. 4,948,761 of George T. Hida, the entire disclosure of which is hereby incorporated by reference into this specification.

Preparation of One-Phase Intermetallic Materials

In one preferred embodiment, in accordance with the process described above, a single-phase material is made from only two reactants. However, in this embodiment, one may also use a diluent to moderate the reaction temperature.

Thus, for example, one may prepare a nickel—aluminide single phase material by charging only elemental nickel and elemental aluminum to the reactor. Alternatively, one may utilize nickel aluminide as a diluent in the system to insure that the reaction temperature does not exceed about 2,000 degrees Centigrade. When such diluent is used, from about 0 to about 55 volume percent (by total volume of all reagents) of the nickel aluminide may be used. Alternatively, or additionally, one may use inclusions which take up space in the composition without participating in the chemical reaction or generate heat.

Preparation of Two Phase Intermetallic Compositions

In one preferred embodiment of applicants' invention, where reinforcing agents are incrporated into the intermetallic composition, a two-phase material is produced.

Substantially any reinforced intermetallic composition may be made by this preferred process of the invention. As is known to those skilled in the art, an intemetallic compound is an alloy of two metals (which includes the borides, hydrides, nitrides, silicides, berylides, and aluminides of the transition elements in the fifth and sixth group in the periodic sequence and semimetallic elements of small diameter). See, e.g., "Intermetallic Compounds," edited by J. H. Westbrook (John Wiley & Sons, Inc., New York, 1967).

In one preferred embodiment, the intermetallic compound made in the process is an aluminide. Thus, by way of illustration and not limitation, one may use TiAl, $Ti_3Al$, NiAl, $Ni_3Al$, FeAl, $Fe_3Al$, CoAl, $Zr_3Al$, $Nb_3Al$, and the like.

In another preferred embodiment, the intermetallic compound made in the procsss is a silicide. Thus, e.g., one may use $MoSi_2$, $Ni_3Si$, and the like.

In one embodiment, the inclusion used is a whisker. The term whisker, as used in this specification, refers to a needle-like single crystal of metallic and nonmetallic compounds; this crystalline form possesses very good strength properties, approaching maximum theoretical strength and making it suitable for reinforcement of metal, ceramic, glass, or polymer matrices.

Other suitable inclusions include chopped fibers with lengths from about 100 microns to 10 centimeters and diameters of from about 5 to 30 microns, "continuous fibers" with lengths of up to about the length of the sample, platelets, particles of inert materials, woven or nonwoven fabric material, and the like.

In one preferred embodiment, mullite whiskers are used as the inclusion.

It is preferred that the particle size of the materials in the reaction mixture 10 range from about 1 to about 44 microns. When titanium is present in the reaction mixture, it is preferred that the particles in the mixture range in size from about 10 to about 44 microns.

In one embodiment, regardless of the "inclusion" used as a reinforcing agent in applicants' process, such inclusion contains only one phase: it is not coated with a separate, allegedly nonreactive, material. As is known to those skilled in the art, the term "phase" refers to a separate, often homogeneously dispersed, fraction of a system. The use of a scanning electron microscope to determine the number of phases in a ceramic material is well known to those skilled in the art; see, e.g., U.S. Pat. No. 5,030,600, the entire disclosure of which is hereby incorporated by reference into this specification. As is well known to those skilled in the art, other methods can be used to determine the number of phases in a ceramic material.

In one embodiment, the inclusion is coated with a separate material.

The intermetallic matrix formed in applicants' process also preferably only contains one phase. Thus, the reinforced matrix preferably only contains two phases. By comparison, many prior art reinforced matrices contain up to four or more phases, including a matrix phase, a reinforcemnt phase, a reinforcement coating phase, and a phase produced by the reaction of the reinforcement coating with the matrix.

In applicants' compositions, it is preferred that the composition be comprised of from about 50 to about 99 volume percent of matrix material and from about 50 to about 1 volume percent of reinforcing agent. It is more preferred that the composition contain at least about 60 volume percent of matrix material and at least about 10 volume percent of reinforcing agent.

The following examples are presented to illustrate the claimed invention but are not to be deemed limitative thereof. Unless otherwise specified, all parts are by weight, and all temperatures are in degrees Centigrade.

In the experiments of these examples, a graphite die was used. This die had a cylindrical shape, was 2.0 inches high, had an outside diameter of 1.5 inches, and had an inside diameter of 0.535 inches.

The die was machined from a billet which was obtained from Poco Graphite, Inc. of 1601 State Street, Decatur, Tex. The billet consisted of Poco's type AXZ-5Q graphite, which has a compressive strength of 14,000 pounds per square inch, a thermal conductivity of 75 watts/m K, and a coefficient of thermal expansion of $7.8\times10^{-6}$ inverse degrees Centigrade.

The die cavity was lined with a sheet of "GRAFOIL," a flexible graphite gasketing material sold by the UCAR Carbon Company Inc. of Cleveland, Ohio; the particular "GRAFOIL" material used has a thickness of 0.015 inches.

In the experiments of the Examples, the graphite die was supported on two blocks disposed below the die in a manner to allow the lower ram to pass between them; and the blocks/die/ram assembly was supported on a table. When the reagents used in the experiments were charged to and compacted within the die, steel blocks were used; when the combustion synthesis reactions were taking place, graphite blocks consisting of the aforementioned AXZ-5Q graphite were used.

As illustrated in FIG. 1, an upper and a lower ram were used during the experiments. Each of these rams also consisted of the AXZ-5Q graphite material; and each of them had a outside diameter of 0.5 inches. Depending upon the amount of the material charged to the die and the height of the blocks supporting the die, the length of the rams varied.

The reagents used in these experiments were wet mixed. The reagents were first weighed out into a beaker, and then a sufficient amount of ethyl alcohol (purchased as reagent number 0290 from the Quantum Chemical Corporation, USI Division, Tuscola, Ill.) was added to the beaker to form a slurry. The slurry was then mixed using a Stir Pack Laboratory Mixer, model number 4554-10, sold by the Cole Parmer Instrument Company of Chicago, Ill.; mixing occurred for 30 minutes at an intermediate dial setting of 3.

The slurry thus mixed was tape cast onto a sheet of "MYLAR" polyester film using a doctor blade to form a film which was about 0.015 inch thick. Thereafter, the tape cast slurry was dried by being contacted with cool air flowing over it for about 20 minutes or until it was visibly dry.

In these examples, the lower ram was inserted into the die to the appropriate height, and two "GRAFOIL" disks, each of which was 0.015 inches thick, were disposed within the die cavity abutting the top of the lower ram. Thereafter, the dried reagent mixture was charged to the die cavity and compacted with the upper ram. Then the die/lower ram/upper ram assembly was disposed in a Carver Laboratory Press (model M, manufactured by the Fred S. Carver, Inc. of Menomenee Falls, Wis.), and the reagent mixture was pressed using the Carver Laboratory Press and a force of 600 pounds (which is equivalent to 3,000 pounds per square inch).

An igniter mixture was prepared by mixing 2 moles of submicron-sized boron (obtained from the Callery Chemical Corporation of P.O. Box 429, Pittsburgh, Pa. as "Elemental Boron, Amorphous") with 1 mole of titanium powder, all of whose particles were smaller than 44 microns (obtained from the Johnson Matthey Company as catalog number 10386). In each of the experiments of the Examples, a "GRAFOIL" disk with a thickness of 0.015 inches was placed on the top of the pressed reaction mixture, and 2.2 grams of the igniter mixture were than charged into the die cavity. The igniter mixture/reaction mixture was then pressed again with the Carver Laboratory Press using a force of 600 pounds. Thereafter, two more sheets of the "GRAFOIL" were placed over the compressed igniter mixture; and the hole in the die was packed about half-way full with igniter mixture.

In each of the experiments of the Examples, the die assembly was then placed into a square, steel reaction chamber which was 10"×10"×10", which had steel walls which were 0.25 inches thick, and which had an orifice in its top wall to accommodate a plunger extending therethrough. Within the reaction chamber were disposed two semi-cylindrical heaters (obtained as catalog number 50211 from the Lindberg Corporation of Watertown, Wis.); these heaters had an internal diameter of 2.375 inches, an outside diameter of 3.25 inches, and a height of 2.5 inches: and they were powered by a variac (type 3DN1510 manufactured by Staco Energy Products Co. of Dayton, Ohio).

In these experiments, the die assembly was placed within the reaction chamber, and the heaters were placed around the die assembly. An igniter, powered by another variac, was inserted within the hole of the die and communicated with the igniter mixture within such hole which, in turn, communicated with the igniter mixture within the die.

The deadload assembly depicted in FIG. 2 was used to apply pressure to the reaction mixture within the die. Referring to FIG. 2, the lever arm 32 was a steel beam which was about 4 inches wide by about 0.375 inches thick; it weighed about 104 pounds. The plunger 40 was a piece of refractory brick which abutted a steel plunger which, in turn, was connected to a graphite plunger. The graphite plunger abutted the upper ram of the die assembly.

In these experiments, "FIBERFRAX" insulation (which is comprised of ceramic fiber made from alumina and silica and which is manufactured by the Harbison-Carborundum Corporation of Niagara Falls, N.Y.) was packed around the heater/die assembly. Thereafter, a vacuum of about 1000 microns of mercury was imposed on the system.

EXAMPLE 1

In the experiment of this Example, seven layers of different material were separately charged to the die.

The first layer of material charged to the die consisted of three moles of nickel and one mole of aluminum. The nickel was obtained from the Aldrich Chemical Corporation, of 1001 West Saint Paul Avenue, Milwaukee, Wis. (as catalog number 28.698-2), and all of its particles were between from 1 to 3 microns. The aluminum was obtained from Johsnon Matthey/AESAR Group of Seabrook, N.H. (as catalog number 10576), and it was identified as being "20 micron spherical particles."

The second layer of material charged to the die consisted of a mixture of titanium and carbon, and the aforementioned nickel/aluminum material with the 3/1 mole ratio. The titanium/carbon mixture consisted of 1 mole of titanium to 0.9 moles of carbon; the titanium was obtainted from the Johnson Matthey/AESAR group (catalog number 10386), and the carbon was 1–2 micron particle size (Aldrich catalog number 28,286-3). Ten weight percent of the second material was comprised of the titanium/carbon mixture, and the remainder was comprised of the nickel/aluminum material of layer 1.

The third layer contained 70 weight percent of the aforementioned nickel/aluminum material (of layer 1) plus 30 weight percent of a mixture of the titanium/carbon mixture of layer 2 and, additionally, titanium carbide; 26 percent of the 30 weight percent was titanium carbide (obtained from the Strem Chemical Company of Newburyport, Me. as catalog number 93-2205, and it had a particle size of 2–5 microns. The fourth layer contained 50 weight percent of the nickel/aluminum material of layer 1, and 50 weight percent of the titanium/carbon/titanium carbide mixture of layer 3. Of the fifty percent of the latter mixture, 43.5 weight percent was titanium carbide.

The fifth layer contained 30 weight percent of the nickel/aluminum material of layer 1, and 70 weight percent of titanium carbide and the titanium/carbon mixture. Of such 70 weight percent, 51 weight percent was titanium carbide.

The sixth layer contained 10 weight percent of the nickel/aluminum material of layer 1, and 90 weight percent of titanium carbide and the titanium/carbon mixture. Of such 90 weight percent, 55 weight percent was comprised of titanium carbide.

The seventh layer consisted of 100 weight percent of the titanium/carbon mixture.

0.75 grams of the material of the first layer, 0.5 grams of each of the materials of layers 2, 3, 4, and 5, and 6, and 0.25 grams of the material of the seventh layer, were charged to the die. After each layer was charged, it was compacted by being pressed with the top ram. After all such layers were charged, they were compacted with the Carver Laboratory Press.

The adiabatic temperature of the green body was calculated, and it was found to be about 2,000 degrees Celsius.

Prior to ignition, the material was preheated to a temperature of 550 degrees Centigrade. After such preheating, the mixture was ignited and, thereafter, allowed to cool to room temperature.

The density of the reacted material was determined, and it was found to have a density in excess of 90 percent of the theoretical density.

EXAMPLE 2

In the experiment of this example, the procedure of Example 1 was substantially followed, with the exception that the green body used had an adiabatic temperature in excess 2,000 degrees Centigrade, no titanium carbide moderator was present in the layers of material in this example, and the aforementioned mixture of titanium and carbon replaced the titanium carbide.

The reacted body produced in this experiment was substantially more porous than the body of the experiment of Example 1. X-ray diffraction analysis of such body showed the presence of various nickel—aluminum phases as well as titanium—nickel and titanium—nickel—aluminum alloys.

EXAMPLE 3

The procedure of Example 1 was substantially repeated, with the exception that the amount of titanium carbide diluent in the layers was increased so that the adiabatic temeprature of the system was 1,700 degrees Centigrade. The body produced by the combustion synthesis reaction had a density which was substantially lower than the desnity of the body of Example 1, and it was substantially more porous.

EXAMPLE 4

In the experiment of this Example, a functional gradient body was also prepared by charging seven different layers of material into the die.

The first layer of material charged was a equimolar mixture of nickel and aluminum; the nickel and aluminum reactants were as described in Example 1. 0.75 grams of such material were charged to the die.

The second layer of material charged contained 10 weight percent of the titanium/carbon mixture described in Example 1, and 90 weight percent of the equimolar mixture of nickel and aluminum. 0.5 grams of this material were charged to the die.

The third layer of material charged contained 30 weight of a mixture of titanium carbide and the titanium/carbon mixture, and 70 weight percent of the equimolar mixture of nickel and aluminum. Of the 30 weight percent, 47.5 weight percent was titanium carbide. 0.5 grams of this material were charged to the die.

The fourth layer of material contained 50 weight percent of the equimolar mixture of nickel and aluminum, and 50 weight percent of titanium carbide and the titanium/carbon mixture. Of the 50 weight percent, 52.5 perent was titanium carbide. 0.5 grams of this material were charged to the die.

The fifth layer of material contained 30 weight percent of the equimolar mixture of nickel and aluminum, and 70 weight percent of titanium carbide and the titanium/carbon mixture. Of the 70 weight percent, 55 weight percent was titanium carbide.

The sixth layer contained 10 weight percent of the equimolar mixture of nickel and aluminum, and 90 weight percent of the titanium carbide and the titanium/carbon mixture. Of the 90 weight percent, 56 percent was titanium carbide.

The seventh layer contained 100 percent the titanium/carbon mixture.

The reacted body produced in this Example had a desnity in excess of 90 percent of its theoretical density.

EXAMPLE 5

In the experiment of this example, seven layers of material were charged to the die, and the reaction mixture was preheated to 400 degrees Centigrade.

In the first layer of material, a mixture of 3 moles of nickel and 1 mole of aluminum was charged. 0.75 grams of this material where charged.

In the second layer, a mixture comprised of 90% of nickel/aluminum mixture of layer 1 and 10 weight percent of a mixture of 2 moles of boron and one mole titanium of were charged. 0.5 grams of this mixture were charged.

In the third layer, a mixture comprised of 70% of nickel/aluminum mixture of layer 1 and 30 weight percent of a mixture of titanium diboride powder (whose particles were less than 44 microns), 2 moles of boron, and one mole of titanium were charged. Of the 30%, 23 percent was titanium diboride. 0.5 grams of this mixture were charged.

In the fourth layer, a mixture comprised of 50% of the nickel/aluminum mixture of layer 1 and 50 weight percent of a mixture of titanium diboride, 2 moles of boron and one mole of titanium were charged. Of the 50%, 39 percent was titanium diboride. 0.5 grams of this mixture were charged.

In the fifth layer, a mixture comprised of 30% of the nickel/aluminum mixture of layer 1 and 70 weight percent of a mixture of titanium diboride and 2 moles of boron and one mole of titanium were charged. Of the 70%, 45 percent was titanium diboride. 0.5 grams of this mixture were charged.

In the sixth layer, a mixture comprised of 10% of the nickel/aluminum mixture of layer 1 and 90 weight percent of a mixture titanium of titanium diboride and 2 moles of boron and one mole of titanium were charged. Of the 90%, 49 percent was titanium diboride. 0.5 grams of this mixture were charged.

The seventh layer consisted entirely of two moles of boron and one mole of titanium. 0.5 grams of this mixture were charged.

The reacted body produced in the experiment of this Example had a theoretical density in excess of 90 percent.

EXAMPLE 6

In the experiment of this Example, the procedure of Example 1 was substantially followed. Seven layers of material were charged, and the reaction mixture was preheated to 400 degrees Centigrade.

The first layer consisted of nickel and aluminum in a 1:1 molear ratio. 0.75 grams of this mixture were charged.

In the second layer, 90 percent of the nickel-/aluminum mixture of layer 1 and 10 weight percent of a mixture of two moles of boron and one mole of titanium were charged. 0.5 grams of material were charged.

In the third layer, 70 percent of the nickel/aluminum of layer 1 and 30 percent of a mixture titanium diboride and two moles of boron and one mole of titanium and the igniter mixture were charged; of the 30 percent, 38 was titanium diboride. 0.5 grams of this material were charged.

In the fourth layer, 50 percent of the nickel-/aluminum of layer 1 and 50 percent of a mixture of titanium diboride and a mixture of two moles of boron and one mole of titanium were charged; of the 50 percent, 45 was titanium diboride. 0.5 grams of this material were charged.

In the fifth layer, 30 percent of the nickel/aluminum of layer 1 and 70 percent of a mixture of titanium diboride and a mixutre of two moles of boron and one mole of titanium were charged; of the 70 percent, 48 was titanium diboride. 0.5 grams of this material were charged.

In the sixth layer, 10 percent of the nickel/aluminum of layer 1 and 90 percent of a mixture of titanium diboride and a mixture of two moles of boron and one mole of titanium were charged; of the 90 percent, 49.5 was titanium diboride. 0.5 grams of this material were charged.

The seventh layer consisted entirely of a mixture of two moles of boron and one mole of titanium. 0.5 grams of this material were charged.

EXAMPLE 7

In this experiment, a single-phase material was prepared using a preheating temperature of 550 degrees Centigrade.

Four grams of an equimolar mixture of nickel-/aluminum were charged into the die cavity and covered with the two layers of GRAFOIL. The body produced in the experiment had a density in excess of 98 percent of its theoretical density.

EXAMPLE 8

The procedure of Example 7 was substantially followed, with the exception that 4 grams of a mixture of 3 moles of nickel and 1 mole of aluminum were used. The body produced in this experiment had a density in excess of 98 percent of its theoretical density.

EXAMPLE 9

Figure 3:
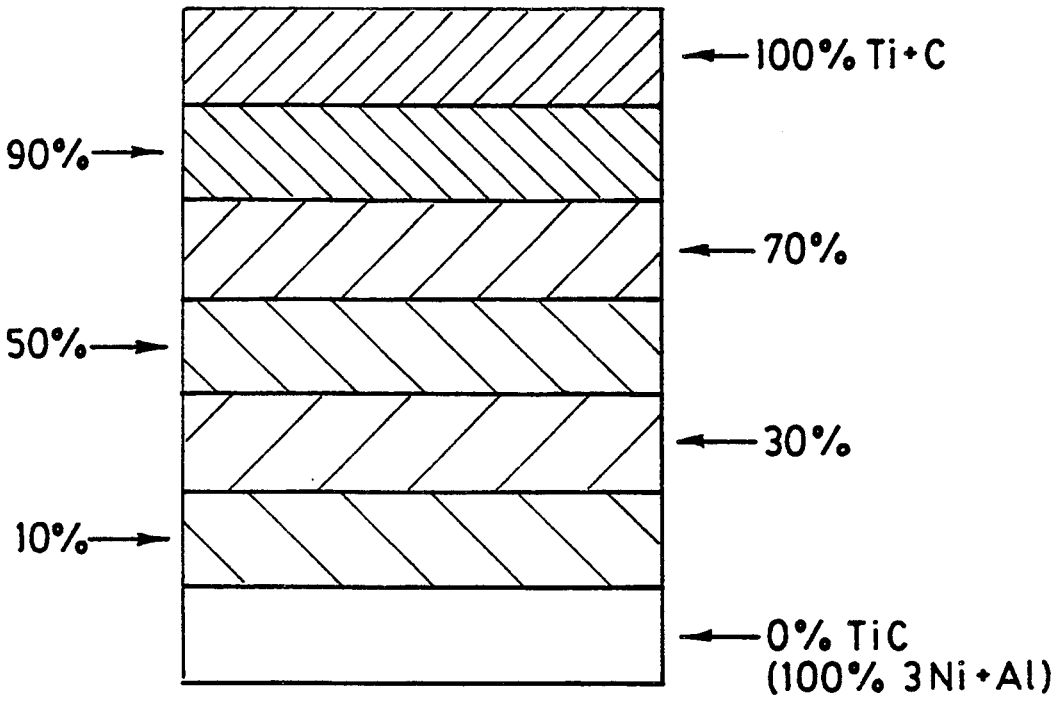
FIG. 3 is a sectional view of a multi-layered material which may be disposed within a graphite die.

The procedure of Example 1 was substantially repeated, with the exception that the reaction mixture was charged in accordance with the manner depicted in FIG. 3.

The body produced in this experiment had a density in excess of 90 percent of theoretical density.

Figure 4:
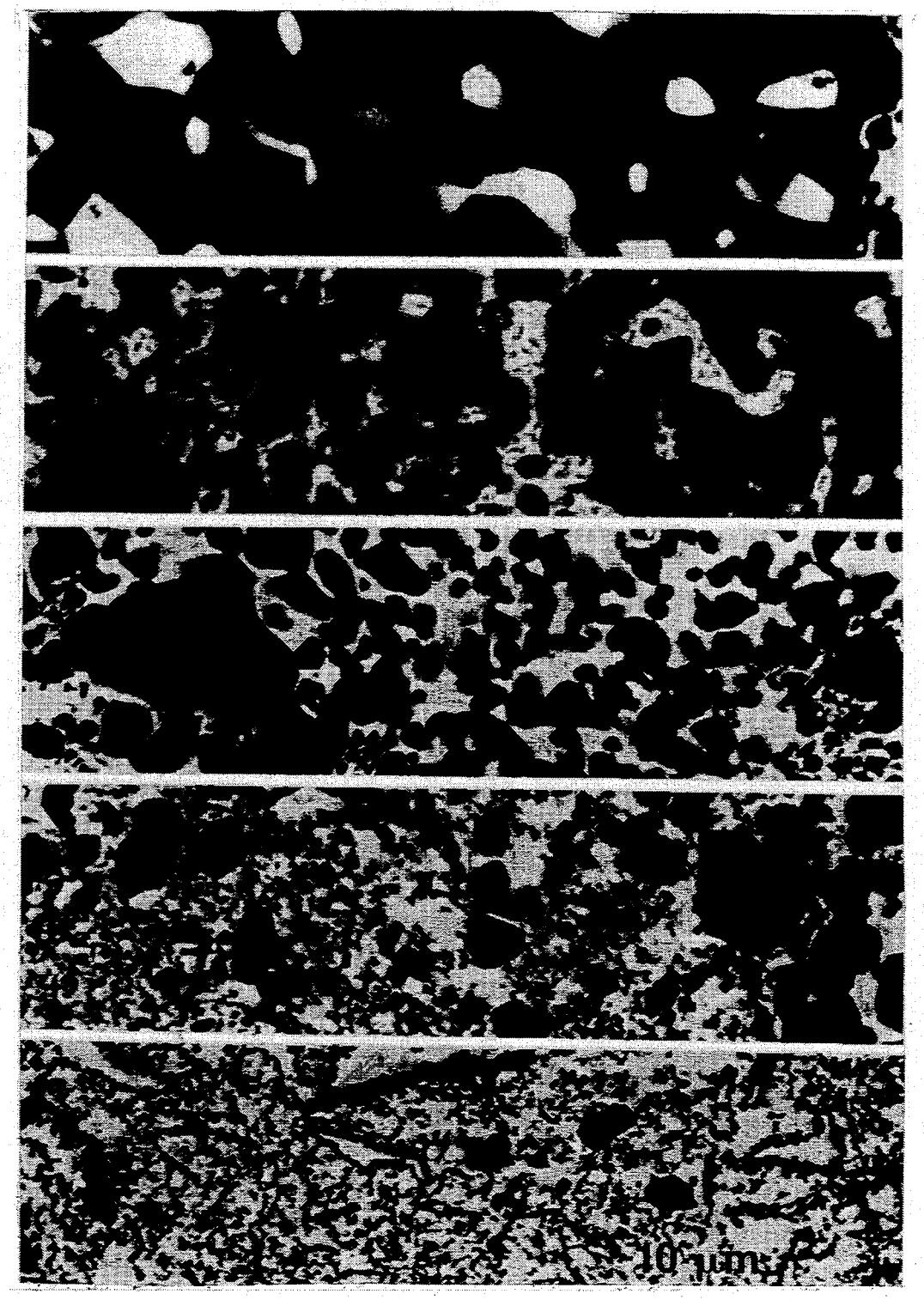
FIG. 4 is a micrograph of the material made with the material of FIG. 3.

The body was sectioned, and a micrograph of the section was taken by scanning electron microscopy. The micrograph obtained is shown in FIG. 4. It will be seen that the phases are well dispersed.

EXAMPLE 10

The procedure of Example 1 was substantially followed, with the exception that the multiplicity of materials charged to the die were charged in separate layers.

In the experiment of this example, alumina fibers (purchased as fiber FP from the E. I. duPont de Nemours Company of Wilmington, Del.) were chopped into lengths of less than 0.25 inches with a scissors.

The aforementioned equimolar mixture of nickel and aluminum was mixed with the chopped fibers in a volume/volume ratio of 20/80 (based upon the volume of the final densified piece, assuming 100 percent of theoretical density of the composite); the mixing occurred in accordance with the procedure of Example 1, using the ethanol, wet mixing, and the tape casting procedures described therein.

4.5 grams of the dried mixture were charged to the die, and 2.5 grams of the aforementioned igniter powder were used. However, no preheating was used in this experiment.

The reacted body had a density of at least about 90 percent of theoretical density. The nickel-aluminum phase completely enclosed the alumina fibers. The composite material was substantially stronger than a nickel—aluminum material which did not contain the fibrous material.

EXAMPLE 11

The procedure of Example number 10 was substantially repeated, but the nickel/alumina mixture contained 3 moles of nickel for each of aluminum. In this experiment, the reaction mixture was preheated to 550 degrees Centigrade.

Figure 5:
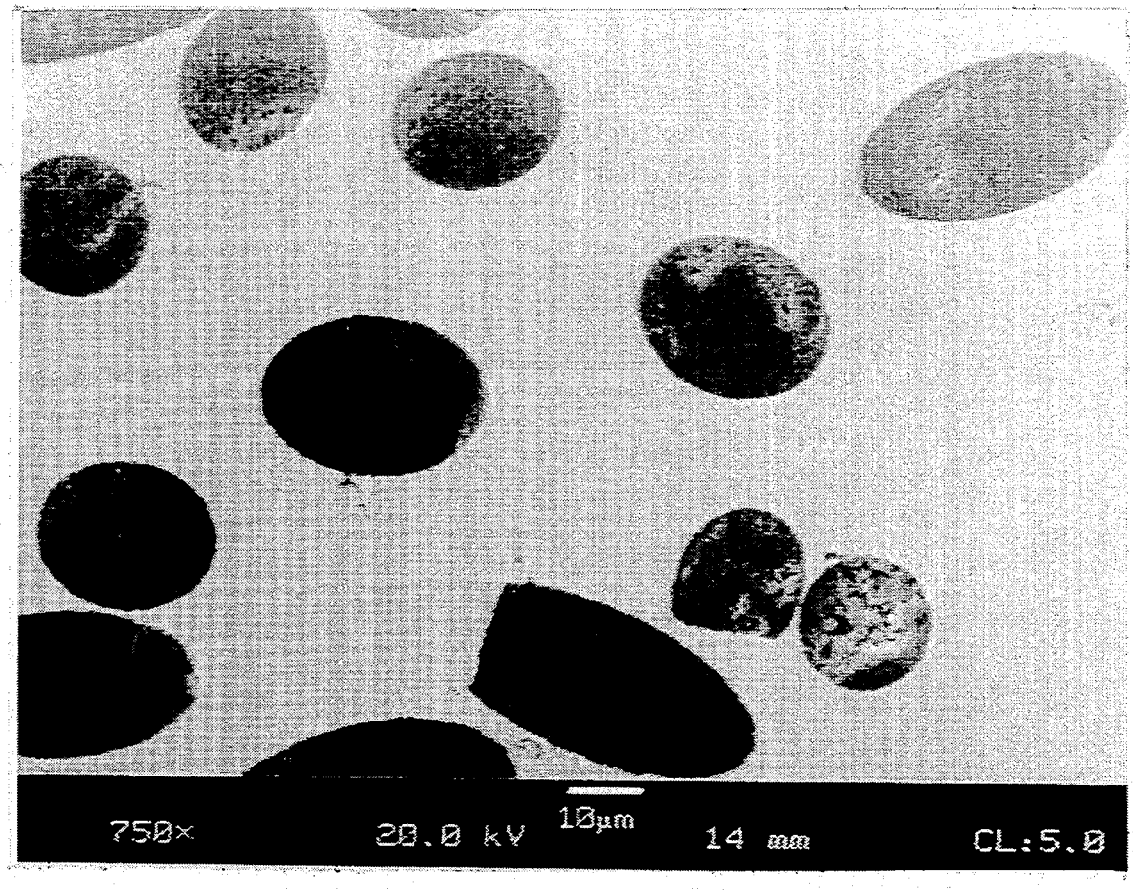
FIG. 5 is a micrograph of a two-phase composition containing a $Ni_3Al$ matrix and alumina fibers reinforcing agent.

The reacted body had a density of at least 98 percent of its theoretical density. A scanning electrom microscope micrograph of a section of the body is presented as FIG. 5; reference to such micrograph reveals the presence of only two phases in the composition.

EXAMPLE 12

The procedure of Example 11 was substantially followed, but mullite whiskers were used instead of the alumina fiber. The mullite whiskers were obtained from the Dow Chemical Corporation; they were 4–12 microns in diameter. The reacted body had a density which was greater than 90% of its theoretical density.

EXAMPLE 13

The procedure of Example 10 was substantially followed, with the exception that titanium diboride particles were used instead of alumina fibers. The titanium diboride particles were less than 44 microns in size; these particles were purchased from Johnson Matthey/AESAR as catalog number 11364.

The reaction mixture was preheated to a temperature of 550 degrees C.

The reacted body produced in the experiment of this example had a density which was greater than 90 percent of its theoretical density.

EXAMPLE 14

A $Ni_3Al$ material was made in substantial accordance with the procedure of Example 8. The top and bottom faces of this body so made were ground until they were substantially parallel to each other, and the thickness of the body was 0.8 inches thick.

This body was charged into the die. Thereafter, the procedure of Example 1 was followed, with the exception that only 0.25 grams of the layer 1 of such Example were charged.

The body formed was then hot pressed under argon, using a flow rate of about 2.5 S.C.F.H. in a Centor M-60 hot press assembly (manufactured by the Centor Vacuum Furnaces Company of Suncook, N.H.) at a pressure of 3000 pounds per square inch, heated at a rate of 10 degrees Centigrade per minute to 700 degrees Centigrade, heated at a rate of 5 degrees Centigrade per minute to 1150 degrees Centigrade, and held for 1 hour at this temperature. Thereafter, the pressure was released, and the temperature was reduced at a rate of 2 degrees Centigrade per minute to 500 degrees Centigrade and then at a rate of 10 degrees Centigrade per minute to room temperature.

The joint formed by the experiment of this example was very strong.

EXAMPLE 15

The procedure of 14 was substantially repeated, using NiAl. The reacted body produced in had properties similar to that of the experiment of Example 15.

EXAMPLE 16

The procedure of 12 was substantially repeated, with the exception that $Ni_3Al$ was used, and a titanium carbide disc (which was 0.20" thick and was made by hot pressing a mixture of titanium carbide and 6 weight percent of nickel). The faces of the disk were ground until they were substantially parallel, and the thickness of the disk was 0.02 inches. The density of the disk produced was greater than 98 percent of theoretical density.

One face of this disk was polished to surface roughness, and the titanium carbide side of the coating to a surface roughness of one micron. The two surfaces were placed together and hot pressed as before, being heated at a rate of 10 degrees Centigrade per minute to 1000 degrees Centigrade, then 3 degrees Centigrade per minute to a temperature of 1,150 degrees Centigrade, then held at 1,150 degrees Centigrade for two hours, then the pressure was released, then cooled at 2 degrees Centigrade per minute to room temperature; the entire heat treatment occurred under continuous flow of argon gas at a flow rate of 2.5 S.C.F.H. The reacted body had an excellent joint with very few voids between the preformed titanium carbide disk and the FGM body.

EXAMPLE 17

The procedure of Example 8 was substantially repeated, with the exception that 4 grams of the "igniter material" were used. A fine-grained, reacted body with a density in excess of 98 percent of theoretical density was obtained.

EXAMPLE 18

The procedure of Example 11 was substantially repeated, with the exception that a composite material was made from the $Ni_3Al$ matrix and "NEXTEL" fabric. "NEXTEL" is a mullite composition which also contains two percent of boria; it may be purchased from the Minnesota Mining and Manufacturing Corporation of Saint Paul, Minn.

In substantial accordance with the procedure of Example 13, a composite was made from the nickel-/aluminum matrix and the "NEXTEL" fabric.

A disk with an inner diameter of 0.5 inches was cut from the "NEXTEL" fabric; the fabric had a thickenss of less than 1 millimeter.

2 grams of the nickel/aluminum mixture were charged to the die and compacted by hand. Thereafter, one of the "NEXTEL" fabric disks was inserted into the die. Then 2 grams of the nickel/aluminum mixture were charged into the die and hand compacted. Then 2.5 grams of the igniter mixture were charged to the die and hand compacted. This whole assembly was then preheated to 550 degrees Centigrade and ignited in the manner described above.

The body so produced had a density which was greater than 98 percent of the theoretical density. The reacted body exhibited excellent penetration of the nickel/aluminum phase through the the fabric.

EXAMPLE 19

The procedure of Example 18 was substantially followed, with the exception that every other strand in the NEXTEL fabric disks were removed to make a more open structure for the disks. The mechanical properties of the reacted body of this example were superior to the mechanical properties of the reacted body of the experiment of Example 18.

EXAMPLE 20

The procedure of Example 19 was substantially followed, with the exception that 1 gram of the nickel-/aluminum mixture was charged to the die and compacted by hand. Thereafter, one of the "NEXTEL" fabric disks was inserted into the die. Then 0.1 grams of grams of the nickel/aluminum mixture were charged into the die and hand compacted. This process was repeated six times until six layers of the fabric were in the assembly. Then 1.0 gram of the nickel/aluminum mixture was charged to the die and compacted by hand. Then 2.5 grams of the igniter mixture were charged to the die and hand compacted.

EXAMPLE 21

The procedure of Example 19 was substantially followed, with the exception that a United States penny was first with the face of Abraham Lincoln facing upwardly was first charged to the die. A mold was formed in the bottom of the intemetallic composition with Mr. Lincoln's features impressed into it.

EXAMPLE 22

The procedure of Example 7 was substantially followed, with the exceptions that the intermetallic phase was formed from molybdenum powder and silicon powder, in a ½ molar ratio. Both powders were obtained from Strem Chemical, Inc. of Newburyport, Me. The molybdenum powder was catalog number 93-4257. The silicon powder was catalog number 93-1496.

The composition produced by the experiment of this Example had a density greater than 90 percent of its theoretical density.

EXAMPLE 23

The procedure of Examle 22 was substantially followed, with the exception that 10 volume percent of the alumina fibers described in Example 10 were incorporated into the matrix in accordance with the procedure described in Example 10.

EXAMPLE 24

The procedure of Example 23 was substantially followed, with the excpeion that 20 volume percent of such alumina fibers were used.

EXAMPLE 25

The procedure of Example 23 was substantially followed, with the exception that 30 volume percent of such alumina fibers were used.

EXAMPLE 26

The procedure of Example 23 was substantially followed, with the excption that 40 volume percent of such alumina fibers were used.

COMPARATIVE EXAMPLE 27

The procedure of Example 7 was substantially followed, with the exception that titanium powder and aluminum powder in a 1:1 mole ratio was used as the charge.

Unlike the product produced in Example 7 (which contained only one phase), a material which was neither one-phase nor an alloy was obtained. The material had some characteristics of a solid solution.

COMPARATIVE EXAMPLE 28

The procedure of Exampe 27 was substantially followed, with the exception that the titanium powder and aluminum powder were used in a 3:1 mole ratio. Equally unsatisfactory results were obtained, the material being neither one-phase nor an alloy.

Applicants believe, but are not yet certain, that if they preheat the reactants to a temperature of about 1,000 to about 1,100 degrees centigrade, they may obtain a one-phase alloy material.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

We claim:

1. A process for producing a dense composite material by combustion synthesis, wherein said composition consists of from about 55 to about 99 volume percent of a matrix and from about 1 about 45 volume percent of reinforcing agent and contains only of a first phase and a second phase, wherein said matrix is an intermetallic compound selected from the group consisting of a metal aluminide and a metal silicide, and wherein said composition has a density of at least about 95 percent of its theoretical density; comprising the steps of sequentially:

(a) selecting a first elemental material from the group consisting of lithium, titanium, zirconium, hafnium, unnilquadium, vanadium, niobium, tantalum, unnilpentium, chromium, molybdenum, tungsten, unnilseptium, nickel, palladium, platinum, cobalt, copper, and germanium;

(b) selecting a second elemental material from the group consisting of aluminum and silicon;

(c) mixing said first elemental material, said second elemental material, and reinforcing agent, thereby providing a reaction mixture;

(d) charging said reaction mixture to a die;

(e) charging an ignitable primer into said die;

(f) applying a uniaxial pressure of from about 500 to about 5,000 pounds per square to said reaction mixture within said die; and (g) heating said reaction mixture within said die to a temperature of from about 250 to about 600 degrees Centigrade, thereafter igniting said ignitable primer within said die, and thereafter igniting said reaction mixture within said die, wherein, prior to, during, and subsequent to the time said reaction mixture has been ignited, said uniaxial pressure of from about 500 to about 5,000 pounds per square inch is applied to said reaction mixture within said die.

2. The process as recited in claim 1, wherein said first elemental material is selected from the group consisting of lithium, zirconium, hafnium, vanadium, niobium, tantalum, chromium, nickel, palladium, platinum, cobalt, copper, and germanium.

3. The process as recited in claim 2, wherein said second elemental material is aluminum.

4. The process as recited in claim 3, wherein said first elemental material is selected from the group consisting of molybdenum, nickel, and titanium.

5. The process as recited in claim 3, wherein said second elemental material is nickel.

6. The process as recited in claim 5, wherein said nickel and said aluminum are mixed with from about 1 to about 45 volume percent (by total volume of nickel, aluminum, and reinforcing agent) of reinforcing agent.

7. The process as recited in claim 6, wherein said nickel and said aluminum are mixed with from about 10 to about 45 volume percent (by total volume of nickel, aluminum, and reinforcing agent) of reinforcing agent.

8. The process as recited in claim 7, wherein said reinforcing agent is a whisker material.

9. The process as recited in claim 7, wherein said reinforcing agent is a chopped fiber material wherein said chopped fiber has a length of from about 100 microns to about 10 centimeters and a diameter of from about 5 to about 30 microns.

10. The process as recited in claim 7, wherein said reinforcing agent is continuous fiber.

11. The process as recited in claim 7, wherein said reinforcing agent is a nonwoven fabric material.

12. The process as recited in claim 7, wherein said reinforcing agent consists essentially of mullite whiskers.

13. The process as recited in claim 7, wherein said reinforcing agent consists essentially of alumina whiskers.

14. The process as recited in claim 7, wherein said reinforcing agent consists essentially of titanium diboride particles.

15. The process as recited in claim 7, wherein a mixture of one mole of said nickel and one mole of said alumimum is mixed with said reinforcing agent.

16. The process as recited in claim 7, wherein a mixture of three moles of said nickel and one mole of said aluminum is mixed with said reinforcing agent.

17. The process as recited in claim 1, wherein said first elemental material is molybdenum and said second elemental material is silicon.

18. The process as recited in claim 17, wherein a mixture of one mole of molybdenum and two moles of silicon are mixed with said reinforcing agent.

19. The process as recited in claim 18, wherein said reinforcing agent consists essentially of alumina fibers.

* * * * *